US008974030B2

(12) United States Patent
Suzuki

(10) Patent No.: US 8,974,030 B2
(45) Date of Patent: Mar. 10, 2015

(54) LIQUID EJECTING APPARATUS, AND NON-TRANSITORY, COMPUTER-READABLE MEDIA THEREFOR

(71) Applicant: Katsuaki Suzuki, Nagoya (JP)

(72) Inventor: Katsuaki Suzuki, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 43 days.

(21) Appl. No.: 13/851,361

(22) Filed: Mar. 27, 2013

(65) Prior Publication Data

US 2014/0092155 A1 Apr. 3, 2014

(30) Foreign Application Priority Data

Sep. 28, 2012 (JP) ..... 2012-218359

(51) Int. Cl.
*B41J 29/38* (2006.01)
*B41J 2/045* (2006.01)

(52) U.S. Cl.
CPC ..... *B41J 2/04573* (2013.01); *B41J 2/04541* (2013.01); *B41J 2/04553* (2013.01); *B41J 2/0458* (2013.01); *B41J 2/04581* (2013.01); *B41J 2/04591* (2013.01); *B41J 2/04595* (2013.01); *B41J 2/04596* (2013.01)
USPC ..... 347/14

(58) Field of Classification Search
CPC ..... B41J 2/04501; B41J 2/04505; B41J 2/04506; B41J 2/04548; B41J 2/04591; B41J 2/04573; B41J 2/04521; B41J 2/0543; B41J 2/04545
USPC ..... 347/14
See application file for complete search history.

(56) References Cited

U.S. PATENT DOCUMENTS

| | | | | |
|---|---|---|---|---|
| 6,908,173 | B2 * | 6/2005 | Otsuki et al. | 347/19 |
| 7,909,426 | B2 * | 3/2011 | Kim | 347/19 |
| 8,208,174 | B2 * | 6/2012 | Kieser et al. | 358/2.1 |

FOREIGN PATENT DOCUMENTS

| | | | |
|---|---|---|---|
| JP | 2002036522 | A | 2/2002 |
| JP | 2006315322 | A | 11/2006 |

* cited by examiner

*Primary Examiner* — Alessandro Amari
*Assistant Examiner* — Michael Konczal
(74) *Attorney, Agent, or Firm* — Banner & Witcoff, Ltd.

(57) ABSTRACT

A liquid ejecting apparatus may have a head with a plurality of head units. Each head unit may include a driver IC. An ejection timing signal (FIRE) may be transmitted from a control device to each of the driver ICs through an ejection timing signal line, which may be connected to the control device as a single line and split on its way to the driver ICs. The control device may further output delay information indicating a delay amount for the FIRE signal to the driver ICs through a control signal line through which a waveform pattern selection signal (SIN) is also transmitted. Each of the driver ICs may include a delay circuit that delays the FIRE signal by the delay amount indicated by the delay information.

18 Claims, 10 Drawing Sheets

LIQUID EJECTING APPARATUS, AND NON-TRANSITORY, COMPUTER-READABLE MEDIA THEREFOR

CROSS REFERENCE TO RELATED APPLICATION

This application claims priority from Japanese Patent Application No. 2012-218359, filed on Sep. 28, 2012, the disclosure of which is incorporated herein by reference in its entirety.

BACKGROUND

1. Technical Field

The present disclosure relates to a liquid ejecting apparatus including a liquid ejecting head that ejects a liquid through a nozzle, and a non-transitory computer-readable medium for the liquid ejecting apparatus.

2. Description of the Related Art

Liquid ejecting apparatuses thus far developed include a serial printing type that makes a liquid ejecting head reciprocate in a main scanning direction for recording, and a line printing type in which the liquid ejecting head is fixed. The liquid ejecting head of the line printing type liquid ejecting apparatus typically includes a plurality of head chips aligned therein.

BRIEF SUMMARY

In the foregoing line printing type apparatus, when the location of the plurality of head chips (head units) is different from an ideal state (position is deviated), the recording performance may be degraded. Accordingly, the present disclosure attempts to correct the position deviation by inputting a driving pulse having a different delay amount to each of the plurality of driver ICs respectively corresponding to the plurality of head units. One way to input the driving pulse having a different delay amount to each of the driver ICs from a control device is to use the same number of signal lines as that of the driver ICs. However, the increase in number of signal lines may result in various drawbacks, such as greater impact of noise to peripheral circuits and increase in size of the liquid ejecting apparatus.

Accordingly, aspects of this disclosure provide a liquid ejecting apparatus configured to reduce or prevent degradation of recording performance originating from position deviation of a plurality of head units. Other aspects of this disclosure provide a liquid ejecting apparatus with reduced wirings.

A liquid ejecting apparatus disclosed herein may comprise a liquid ejecting head including a plurality of head units each having a nozzle row including a plurality of nozzles for ejecting liquid of the same color. The plurality of head units may be arranged such that the nozzle rows of the respective head units are approximately parallel to each other. The plurality of head units each may include a plurality of pressure chambers each communicating with a corresponding one of the plurality of nozzles, a plurality of actuators each disposed so as to correspond to one of the pressure chambers and each configured to apply force to the liquid stored in the corresponding pressure chamber for ejecting the liquid through the nozzle communicating with the corresponding pressure chamber, on the basis of a corresponding driving signal, and a plurality of drive control devices each disposed so as to correspond to one of the head units and each configured to output the corresponding driving signal to the corresponding actuator in the corresponding head unit. The liquid ejecting apparatus also may comprise a control device, an ejection timing signal line connected to the control device as a single signal line that is split en route to the drive control devices into a plurality of signal lines each connected to a corresponding one of the drive control devices, and a plurality of control signal lines each connecting the control device and a corresponding one of the drive control devices. The control device may be configured to generate an ejection timing signal indicating an ejection timing of the liquid and control signals that control operation of the head units. The control device may also be configured to generate delay information indicating a time for delaying the ejection timing signal. Further, the control device may output the generated ejection timing signal to the ejection timing signal line, so as to be received by the drive control devices, and to output each of the generated control signals to one of the control signal lines corresponding to a desired one of the drive control devices, so as to be received by the desired drive control device. The control device may be configured to output the generated delay information to one of the control signal lines corresponding to a desired one of the drive control devices, so as to be received by the desired drive control device. Each of the plurality of drive control devices may be configured to generate the corresponding driving signal based on the corresponding control signal received via the corresponding control signal line. Each of the plurality of drive control devices may be configured to delay the received ejection timing signal by the time indicated by the delay information received via the corresponding control signal line. Each of the plurality of drive control devices may be configured to output the corresponding driving signal to be received by the desired one of the actuators in accordance with a timing indicated by the delayed ejection timing signal.

Aspects of the disclosure also include one or more non-transitory, computer-readable media that may store computer-readable instructions therein that, when executed by one or more processors, may instruct the liquid ejecting apparatus to execute certain processes. The computer-readable instructions may instruct the liquid ejecting apparatus to execute a process of generating an ejection timing signal indicating an ejection timing of the liquid. The computer-readable instructions may instruct the liquid ejecting apparatus to execute a process of generating control signals that control operation of the head units. The computer-readable instructions may also instruct the liquid ejecting apparatus to execute a process of generating delay information indicating a time for delaying the ejection timing signal. The computer-readable instructions may instruct the liquid ejecting apparatus to execute a process of outputting the generated ejection timing signal to the ejection timing signal line, so as to be received by the drive control devices. The computer-readable instructions may instruct the liquid ejecting apparatus to execute a process of outputting one control signal among the generated control signals. The computer-readable instructions may also instruct the liquid ejecting apparatus to execute a process of outputting the generated delay information to one of the control signal lines corresponding to a desired one of the drive control devices, so as to be received by the desired drive control device. The computer-readable instructions may instruct the liquid ejecting apparatus to execute a process of generating one of the driving signals based on the outputted control signal. The computer-readable instructions may instruct the liquid ejecting apparatus to execute a process of delaying the ejection timing signal by the time indicated by the delay information. The computer-readable instructions may instruct the liquid ejecting apparatus to execute a process of outputting the generated driving signal to be received by a desired one of the actuators in accordance with a timing indicated by the delayed ejection timing signal.

A liquid ejecting apparatus having a configuration disclosed herein enables the liquid ejecting apparatus to reduce or prevent degradation of recording performance originating from position deviation of the head units. The configuration may also reduce degradation using relatively few wires (e.g., signal lines).

BRIEF DESCRIPTION OF THE DRAWINGS

Some features disclosed herein are illustrated by way of example, and not by way of limitation, in the figures of the accompanying drawings in which like reference numerals refer to similar elements.

DETAILED DESCRIPTION

Hereafter, example embodiments of the present application will be described with reference to the drawings.

Figure 1:
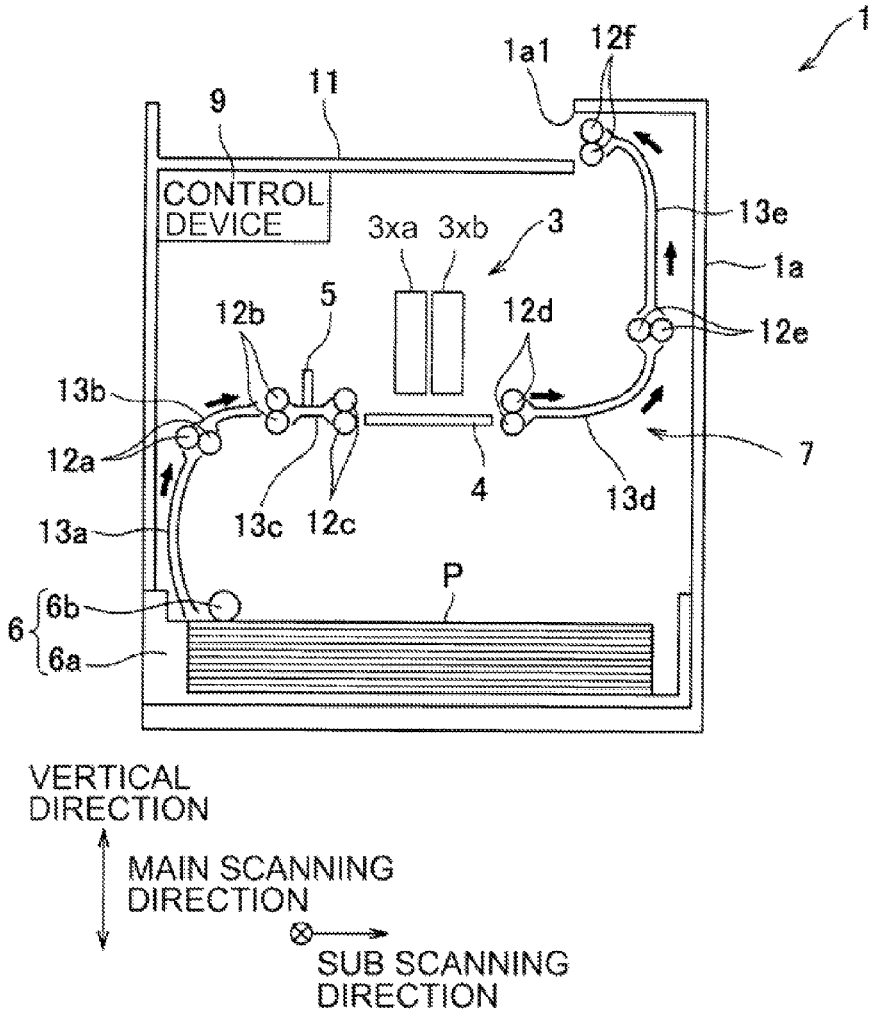
FIG. 1 is a schematic illustrating a side view of an internal structure of an ink jet printer according to an example embodiment of the present disclosure.

Referring first to FIG. 1, a general configuration of an ink jet printer 1 will be described.

The printer 1 may include a casing 1*a* of a rectangular block shape. A paper discharge tray 11 may be provided on a top plate of the casing 1*a*. Inside the casing 1*a*, an ink jet head 3 (hereinafter, simply head 3), a platen 4, a paper sensor 5, a paper feed unit 6, a conveying device 7, a control device 9 and so forth are enclosed. A convey route along which a paper sheet P is conveyed from the paper feed unit 6 to the paper discharge tray 11 is configured inside the casing 1*a*, as indicated by arrows in FIG. 1.

Figure 2A:
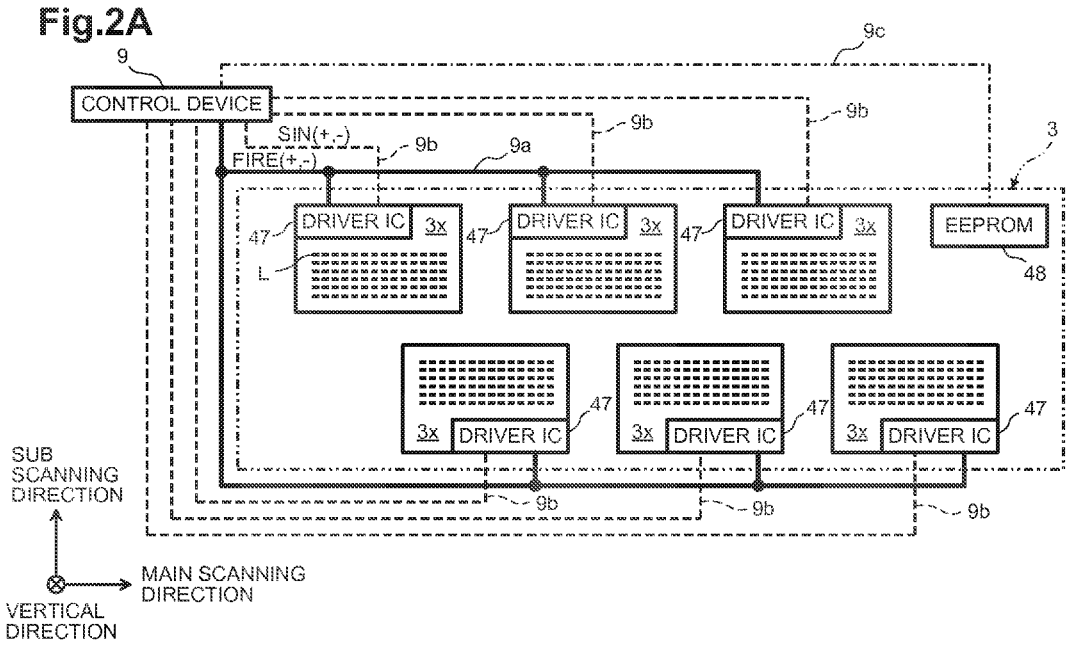
FIG. 2A is a plan view showing an example configuration of ink jet heads.
Figure 2B:
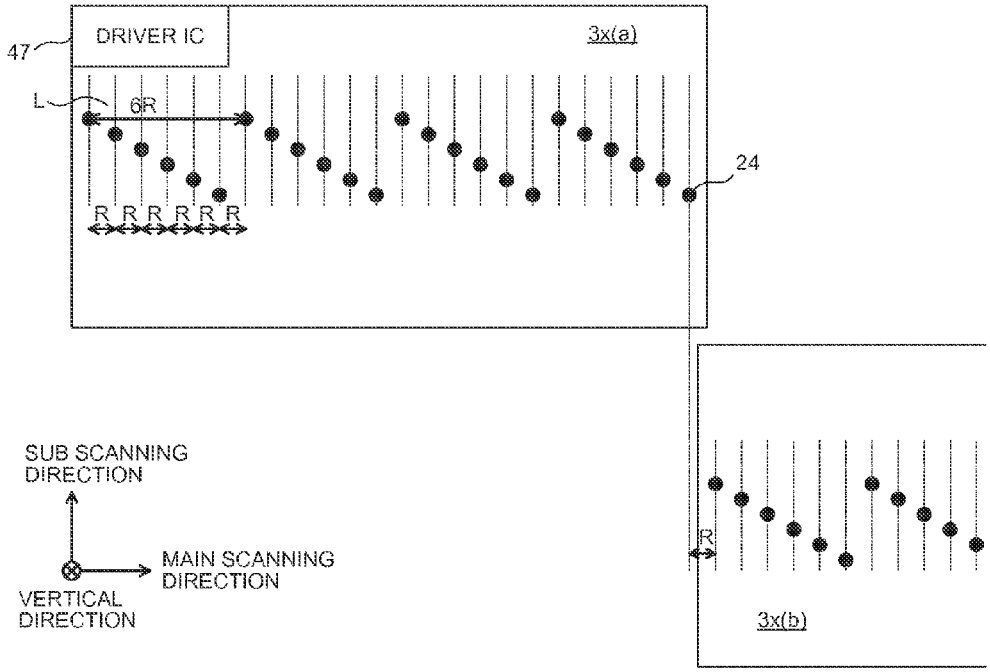
FIG. 2B is an enlarged plan view of an example head unit.

The head 3 may include three head units 3*xa* and three head units 3*xb* arranged in a checkerboard pattern with an interval therebetween, in a main scanning direction (see FIGS. 2A, 2B). Although the head units 3*xa* and the head units 3*xb* may have the same structure, the head units 3*xa* are located upstream of the head units 3*xb* in a direction in which the paper sheet P is conveyed by the conveying device (hereinafter, simply "convey direction"). Hereafter, provided that the head units 3*xa* and the head units 3*xb* do not need to be distinguished, these will be simply referred to as head unit 3*x*. The head unit 3*x* includes six nozzle rows L aligned in a sub scanning direction, each including a plurality of nozzles 24 aligned in the main scanning direction at a predetermined interval 6R. A nozzle 24 of one of the nozzle rows and a closest nozzle 24 of the adjacent nozzle row in the sub scanning direction are offset by an interval R in the main scanning direction. Accordingly, the head unit 3*x* is configured so as to print dots at the intervals R in the main scanning direction. In addition, between a head unit 3*xa* and a head unit 3*xb* diagonally adjacent to each other, the nozzles 24 of the respective head units closest to each other in the main scanning direction are spaced by the interval R. Thus, the printer 1 is a line printing type of printer that performs recording with the head unit 3*x* fixed. In an image recorded on the paper sheet P, the interval between two dots closest to each other in the main scanning direction is R. During the manufacturing process of the head 3, the six head units 3*x* are ideally positioned at specific reference positions in the sub scanning direction. However, it is difficult to completely eliminate position deviation when mounting the head units 3*x* on the head 3. According to aspects of this disclosure, therefore, the ink jet printer 1 may be configured to delay the ink ejection timing, on the premise that the head units 3*x* are deviated (e.g., to the downstream side) in the sub scanning direction from the reference position on the head 3, to thereby correct the deviation of the ink landing position in the sub scanning direction. The specific configuration of the head 3 will be subsequently described in detail.

The platen 4 may be a plate-shaped member. The platen 4 may be disposed so as to oppose the six head units 3*x* in a vertical direction. A predetermined gap appropriate for recording (forming images) may be defined between the upper surface of the platen 4 and the lower surface of each head unit 3*x*.

The paper sensor 5 may be located upstream of the head 3 in the convey direction. The paper sensor 5 may detect the leading edge of the paper sheet P and may output a detection signal. The outputted detection signal may be inputted to the head control circuit 53*a* (see FIG. 5A).

The paper feed unit 6 includes a paper feed tray 6*a* and a paper feed roller 6*b*. The paper feed tray 6*a* may be removably mounted in the casing 1*a*. The paper feed tray 6*a* may have a box shape with an open upper face, so as to accommodate therein a plurality of paper sheets P. The paper feed roller 6*b* may be driven to rotate by a paper feed motor 6M (see FIG. 5A) under the control of the control device 9, so as to draw out an uppermost one of the paper sheets P in the paper feed tray 6*a*.

The conveying device 7 includes pairs of rollers 12*a*, 12*b*, 12*c*, 12*d*, 12*e*, and 12*f*, and guides 13*a*, 13*b*, 13*c*, 13*d*, and 13*e*. The pairs of rollers 12*a* to 12*f* are mounted in this order along the convey route, from the upstream end to the downstream end in the convey direction. In the respective pairs of rollers 12*a* to 12*f*, one roller may be a driving roller driven to rotate by a convey motor 7M (see FIG. 5A) under the control of the control device 9. The other roller may be a slave roller made to rotate by the rotation of the driving roller. The guides 13*a* to 13*e* are mounted in this order along the convey route, from the upstream end to the downstream end in the convey direction, alternately with the pairs of rollers 12*a* to 12*f*. The guides 13*a* to 13*e* may be configured to guide a paper sheet P along the convey route and may each include a pair of plates opposing each other. An encoder 2 (see FIG. 5A) may be attached to the driving roller of the pair of rollers 12*c*. The encoder 2 may output pulse signals in synchronization with the rotation of one or both rollers of the pair of rollers 12*c*. The outputted pulse signals may be inputted to the head control circuit 53*a*. The encoder 2 may be set to transmit a pulse signal each time the pair of rollers 12*c* rotate by an amount necessary to make the paper sheet P move with respect to the head 3 by a unit distance corresponding to the resolution of the image to be printed on the paper sheet P.

The paper sheet P drawn out from the paper feed unit 6 under the control of the control device 9 is pinched by the pairs of rollers 12*a* to 12*f* and conveyed in the convey direction through the guides 13*a* to 13*e*. When the paper sheet P is positioned under the head units 3*x* and over the upper surface of the platen 4, black ink is ejected through the nozzles 24 (see FIG. 3) onto the surface of the paper sheet P under the control of the control device 9. The ink ejection through the nozzle 24 may be performed on the basis of the detection signal outputted by the paper sensor 5 and the pulse signal outputted by the encoder 2. The paper sheet P on which the image has been formed may be discharged to the paper discharge tray 11 through an opening 1*a*1, which may be formed on the top portion of the casing 1*a*.

Figure 3:
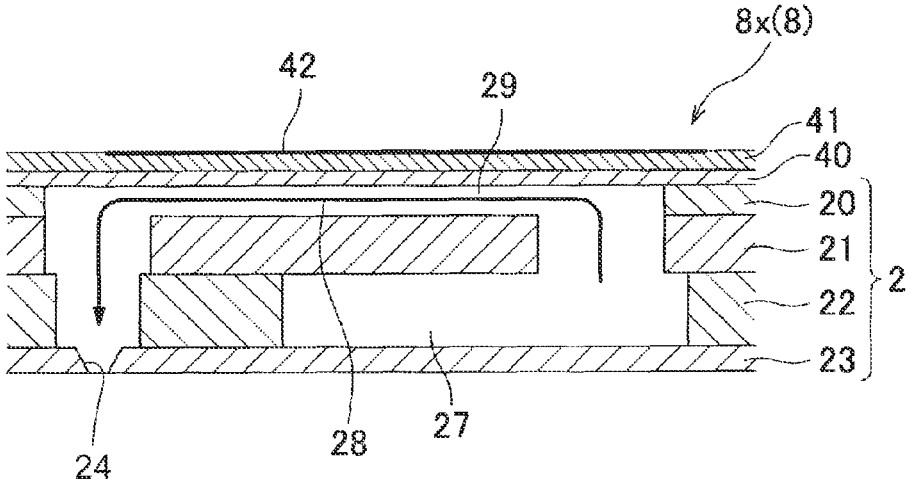
FIG. 3 is a cross-sectional view showing an individual flow path of an example head unit.

Referring now to FIGS. 2A and 3, the specific configuration of the head 3 will be described. FIG. 2A also depicts a connection between the control device 9 and each of the head units 3*x*.

The six head units 3*x* may have the same structure, and each may include a flow path unit 2, an actuator device (see FIG. 3), and a driver IC 47 (see FIG. 2A).

As shown in FIG. 3, the flow path unit 2 may have a layered structure. The layered structure may include four rectangular metal plates 20, 21, 22, and 23 of similar or varying sizes, in which a flow path is formed. The flow path includes a manifold path 27 and a plurality of individual flow paths 28 that branch off from the manifold path 27. The individual flow paths 28 are provided for each of the nozzles 24, between the outlet of the manifold path 27 and the nozzle 24 through the pressure chamber 29. In the cross-sectional view of FIG. 3, only one individual flow path 28 is depicted. Other individual flow paths 28 may be similarly constructed. The plurality of nozzles 24 are may be formed by openings in the lower surface of the flow path unit 2. Each of the plurality of pressure chambers 29 may connect to a corresponding one of the plurality of nozzles 24. The black ink supplied from a cartridge (not shown) to the manifold path 27 travels through the individual flow paths 28 and is ejected from the respective nozzles 24.

The actuator device 8 may include a flexing plate 40, a piezoelectric layer 41, and a plurality of individual electrodes 42. The flexing plate 40 may be fixed on the upper face of the flow path unit 2 so as to cover the pressure chambers 29. The piezoelectric layer 41 may be fixed to the upper surface of the flexing plate 40, so as to oppose the pressure chambers 29. The individual electrodes 42 may be fixed to the upper surface of the piezoelectric layer 41, so as to oppose a corresponding one of the pressure chambers 29. The flexing plate 40 may be a rectangular plate formed of a conductive material such as a metal. The piezoelectric layer 41 may be formed of a piezoelectric material predominantly composed of lead-zirconium-titanium (PZT), and polarized in the thickness direction (or vertical direction). The upper surface of the flexing plate 40 is located under the lower surface of the piezoelectric layer 41, and thus, may also serve as a common electrode. When the flexing plate 40 acts as the common electrode, the flexing plate 40 may be connected to the ground wiring of the driver IC 47, and may be constantly maintained at the ground potential.

When the driver IC 47 applies a predetermined driving potential to one of the individual electrodes 42, a potential difference may be produced between the individual electrode 42 and the flexing plate 40, and hence an electric field may be generated at the portion of the piezoelectric layer 41 abutting the individual electrode 42. Since the direction of the electric field may be approximately parallel to the thickness direction in which the piezoelectric layer 41 is polarized, the portion of the piezoelectric layer 41 abutting the individual electrode 42 contracts along a plane orthogonal to the thickness direction. At this point, since the flexing plate 40 is fixed to the plate 20, the flexing plate 40 and the portion of the piezoelectric layer 41 opposing the pressure chamber 29 are deformed (e.g., bend) so as to protrude toward the pressure chamber 29 (unimorph deformation). Accordingly, the volume of the pressure chamber 29 is decreased, and a pressure (force) is applied to the ink accommodated in the pressure chamber 29 so that the ink is ejected through the nozzle connected to the pressure chamber 29.

As described above, the portion of the actuator device 8 between each individual electrode 42 and the corresponding pressure chamber 29 serves as an individual unimorph actuator 8*x* for each pressure chamber 29. In other words, the actuator device 8 includes a plurality of actuators 8*x* each provided for a corresponding one of the plurality of pressure chambers 29. Each of the actuators 8*x* can be deformed independently of one another.

The flexing plate 40 and the individual electrodes 42 of the actuator device 8 may be connected to the control device 9 through a flexible printed circuit (FPC) implemented with the driver IC 47.

Each driver IC 47 may selectively transmit a driving signal, according to an instruction from the control device 9, to the individual electrodes 42 of the corresponding one of the six head units 3*x* through the wiring on the FPC. In some embodiments, the driving signal may represent one of eight waveform patterns 4A to 4H shown in FIG. 4. That is, any one of the waveforms shown in FIG. 4 may be sent to any of the individual electrodes 42.

Figure 4A:
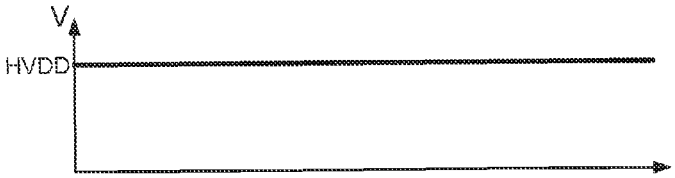
FIGS. 4A-4H include diagrams each showing an example waveform pattern of a driving signal.
Figure 4B:
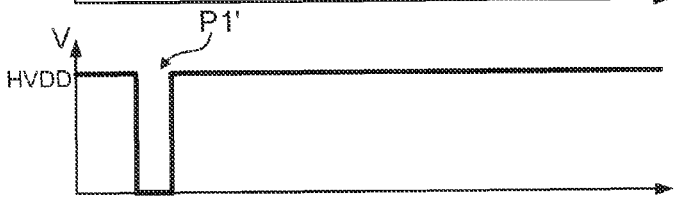
Figure 4C:
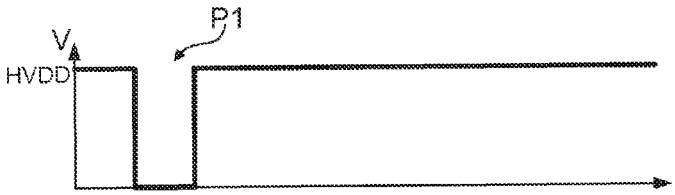
Figure 4D:
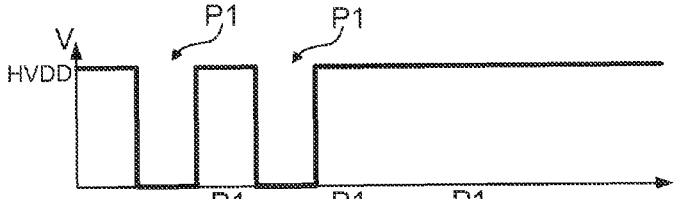
Figure 4E:
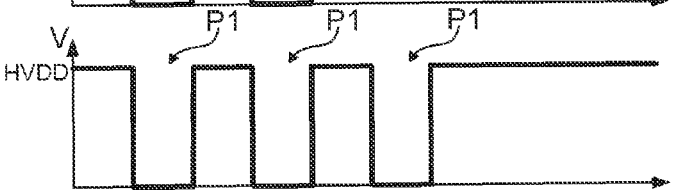
Figure 4F:
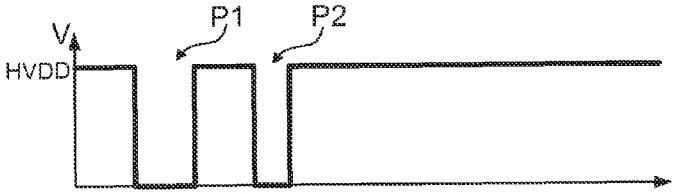
Figure 4G:
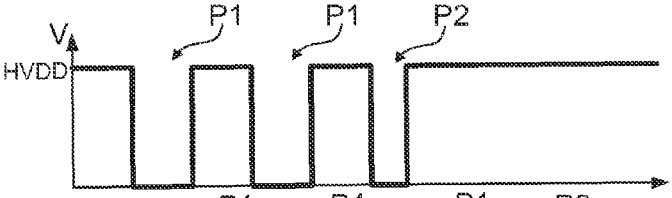
Figure 4H:
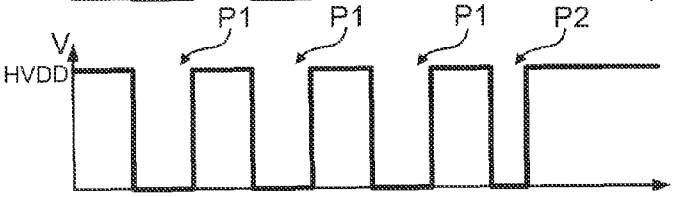

In FIG. 4A, the driving signal corresponding to a non-ejecting pattern (Nil) is a signal of a constant potential (e.g., supply voltage HVDD potential) and does not have a pulse. In contrast, each of FIGS. 4B-4H illustrate a pattern having at least one pulse having a pulse width W. Notably, the pulses may have different pulse widths W. Further, different pulse widths W may cause different amounts of pressure to be applied. Specifically, shorter pulse widths W may apply less pressure while longer pulse widths W may apply more pressure. The driving signals of the Minimal pattern (see FIG. 4B), the Small 1 pattern (see FIG. 4C), and the Small 2 pattern (see FIG. 4F) each possess one of ejection pulses P1' and P1. The ejection pulse P1' of the Minimal pattern (see FIG. 4B) has a narrower pulse width than the ejection pulse P1 of the Small 1 pattern (see FIG. 4C) and the Small 2 pattern (see FIG. 4F), which means that the driving signal of the Minimal pattern applies less pressure to the ink in the pressure chamber 29 than the driving signals of the Small 1 pattern and Small 2 pattern. The driving signals of the Medium 1 pattern (see FIG. 4D) and Medium 2 pattern (see FIG. 4G) each possess two ejection pulses P1. The driving signals of the Large 1 pattern (see FIG. 4E) and Large 2 pattern (see FIG. 4H) each possess three ejection pulses P1. With a greater number of ejection pulses P1, the pressure waves may be superposed in the pressure chamber 29 so that a greater pressure may be applied to the ink, and a larger ink droplet may be ejected through the nozzle 24. The various patterns may produce ink droplets having different volumes. The Minimal pattern may produce a minimal sized droplet. The Small 1 and Small 2 patterns may produce a small sized droplet. The Medium 1 and Medium 2 patterns may produce a medium sized droplet. The Large 1 and Large 2 patterns may produce a large sized droplet. The order, from smallest to largest, of the volume of the ink droplets ejected through the nozzle 24 may be as follows: Minimal<Small<Medium<Large.

In the driving signals of the Small 2 pattern, Medium 2 pattern, and Large 2 pattern, a cancel pulse P2 having a narrower pulse width than the ejection pulse P1 is added to the latter ejection pulse P1. The cancel pulse P2 is added in order to suppress the fluctuation of ink pressure generated by the application of the ejection pulse P1, to thereby minimize the impact of residual pressure wave on the next ejection timing. For example, the patterns Small 2, Medium 2, and Large 2 may be selected when a minimal or small ink droplet, which may be relatively more susceptible to the impact of the residual pressure wave of the preceding ejection timing, is scheduled for the next ejection timing. A CPU 50 may determine which of the wave patterns among Small 1 (see FIG. 4C), Small 2 (see FIG. 4F), Medium 1 (see FIG. 4D), Medium 2 (see FIG. 4G), Large 1 (see FIG. 4E), and Large 2 (see FIG. 4H) is to be adopted to eject a small, medium, and large ink droplet is normally determined by a CPU 50 according to the ambient temperature and the image to be printed.

Referring now to FIGS. 2A, 5A, 5B, and 6, the electrical configuration of the printer 1 will be described.

Figure 5A:
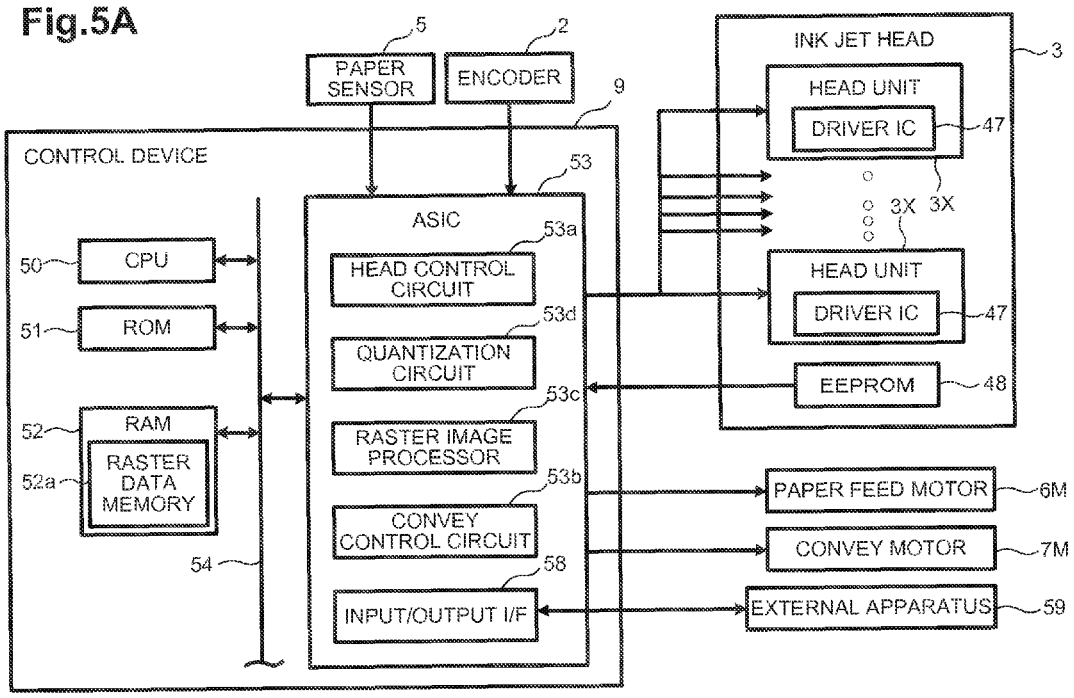
FIGS. 5A and 5B are block diagrams showing an example electrical configuration of a printer and a head control circuit, respectively.

As shown in FIG. 5A, the control device 9 may include the central processing unit (CPU) 50, a read-only memory (ROM) 51, a random access memory (RAM) 52, an application-specific integrated circuit (ASIC) 53, and a bus 54. The ROM 51 may contain programs, various fixed data, and so forth to be executed by the CPU 50. The RAM 52 may temporarily store data needed for executing the program (for example, image data). The RAM 52 may also include a raster data memory 52*a* in which raster data is temporarily stored. The ASIC 53 may include a head control circuit 53*a*, a quantization circuit 53*d*, a Raster image processor 53*c*, a convey control circuit 53*b*, and an input/output interface (I/F) 58. The head control circuit 53*a*, the quantization circuit 53*d*, the Raster image processor 53*c*, and the convey control circuit 53*b* may each include a transfer control circuit, and can transmit and receive signals among one another. The ASIC 53 may be connected to an external apparatus 59, for example, a personal computer (PC), through the input/output I/F 58 so as to perform data communication therebetween. The Raster image processor 53*c* may convert a file to be printed into raster data expressing a multilevel image (for example, an image with 256 gradations) on the basis of the file to be printed and a command written in a printer job language (PJL) and inputted from the external apparatus 59 through the input/output I/F 58. The quantization circuit 53*d* may then convert the multilevel raster data into quinternary data (Nil, Minimal, Small, Medium, and Large). The quantization circuit 53*d* inputs the quinternary raster data to the head control circuit 53*a*. The convey control circuit 53*b* drives, upon receipt of an instruction from the CPU 50, the paper feed motor 6M and the convey motor 7M so as to cause the pairs of rollers to convey the paper sheet P from the paper feed tray 6*a* to the paper discharge tray 11.

Figure 5B:
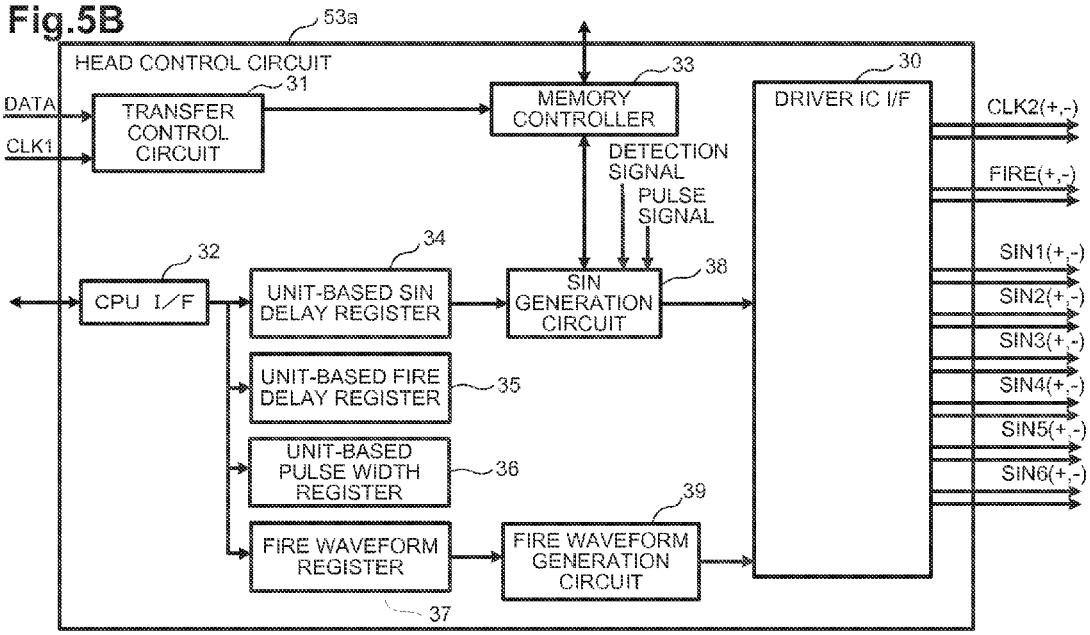

As shown in FIG. 5B, the head control circuit 53*a* may include a transfer control circuit 31, a CPU interface (I/F) 32, a memory controller 33, a unit-based SIN delay register 34, a unit-based FIRE delay register 35, a unit-based pulse width register 36, a FIRE waveform register 37, a SIN generation circuit 38, a FIRE generation circuit 39, and a driver IC I/F 30. The transfer control circuit 31 may be configured to receive DATA representing the quinternary raster data from the quantization circuit 53*d*, in synchronization with a first clock signal CLK 1. The memory controller 33 may be configured to perform direct memory access (DMA) transfer of the DATA to the raster data memory 52*a* of the RAM 52. The memory controller 33 may also perform DMA transfer of data corresponding to an address designated by the SIN generation circuit 38, out of the data stored in the raster data memory 52*a*, from the raster data memory 52*a* to the SIN generation circuit 38. The CPU I/F 32 may be connected to the CPU 50 through the bus 54. Delay information, which will be subsequently described, may be received from the CPU 50 through the CPU I/F 32, and written in the unit-based SIN delay register 34 and the unit-based FIRE delay register 35. Pulse width correction information, which will also be subsequently described, may be received from the CPU 50 through the CPU I/F 32, and written in the unit-based pulse width register 36. The FIRE waveform register 37 may serve to store information indicating which of the wave patterns among Small 1 (FIG. 4*c*), Small 2 (FIG. 4*f*), Medium 1 (FIG. 4*d*), Medium 2 (FIG. 4*g*), Large 1 (FIG. 4*e*), and Large 2 (FIG. 4*h*) is to be adopted to eject a small, medium, and/or large ink droplet. In this embodiment, it will be assumed that the wave patterns Small 1 (FIG. 4*c*), Medium 1 (FIG. 4*d*), and Large 1 (FIG. 4*e*) are employed to eject the small, medium, and large ink droplets, respectively. In other words, the CPU 50 may write information indicating "Small 1", "Medium 1", and "Large 1" in the FIRE waveform register 37. Here, the unit-based SIN delay register 34, the unit-based FIRE delay register 35, the unit-based pulse width register 36 and the FIRE waveform register 37 may be volatile registers, and therefore the data written therein may be erased each time the power for the ASIC 53 is turned off (e.g., disconnected).

The SIN generation circuit 38 may generate a SIN signal and transmit the SIN signal to the driver IC I/F 30. In addition, the detection signal, which is received from the paper sensor 5, and the pulse signal, which is received from the encoder 2, may be provided to the SIN generation circuit 38. The SIN signal may be the control signal for controlling the operation of the head unit 3*x* and, more specifically, a waveform pattern selection signal for selecting the waveform pattern of the driving signal from among the five types of waveform patterns, namely Nil, Minimal, Small, Medium, and Large (see FIGS. 4A-4H). Therefore, the SIN signal may be individually generated with respect to each of the six head units 3*x*. The SIN generation circuit 38 may be configured to generate the SIN signal by allocating each of pixels in the raster data stored in the raster data memory 52*a* to the corresponding head unit 3*x* scheduled to eject the same pixel. The SIN signal thus generated may be transmitted to the corresponding head unit 3*x* through the driver IC I/F 30. After generating a first SIN for the respective head units 3*x*, the SIN generation circuit 38 may generate and transmit the SIN signal in synchronization with each pulse signal.

The SIN generation circuit 38 may store data indicating, with respect to each of the head units 3*xa* and the head units 3*xb*, how many periods of pulse signals are to be received after receiving the detection signal before generating the SIN signal, in the case where the head units 3*x* are located at the reference positions. The SIN generation circuit 38 may start to generate the SIN signal, for example, upon receipt of 1000 periods of pulse signals after receiving the detection signal with respect to the head units 3*xa*, and upon receipt of 1500 periods of pulse signals after receiving the detection signal with respect to the head units 3*xb*. However, when delay information is written in the unit-based SIN delay register 34 in association with a corresponding head unit 3*x* in the delay information generation process (described in further detail below), the SIN generation circuit 38 may delay the start of the generation and transmission of the SIN signal for the respective head units 3*x*, by the ejection period written for the corresponding head unit 3*x*. Alternatively, the SIN generation circuit 38 may expedite the start of the generation and transmission of the SIN signal by the ejection period written in the unit-based SIN delay register 34 for the corresponding head unit 3*x*.

The FIRE generation circuit 39 may generate eight fire (or eject) signals FIREs each having a different waveform, and may input the generated FIRE to the driver IC I/F 30. The eight different waveforms of the FIRE each correspond to one of the Nil wave pattern (FIG. 4A), Minimal wave pattern (FIG. 4B), Small 1 wave pattern (FIG. 4C), Small 2 wave pattern (FIG. 4F), Medium 1 wave pattern (FIG. 4D), Medium 2 wave pattern (FIG. 4G), Large 1 wave pattern (FIG. 4E), and Large 2 wave pattern (FIG. 4H) for ejecting small, medium, and large ink droplets stored in the FIRE waveform register 37. The driver IC I/F 30 transmits the SIN and the FIRE to the driver ICs 47 in synchronization with a second clock signal CLK 2. Here, as will be subsequently described, the SIN and the FIRE are transmitted to the respective head units 3*x* as serial data, through the driver IC I/F 30. Therefore, the second clock signal CLK 2 may be set with a sufficiently higher frequency than the ejection period. The second clock signal CLK 2 may be inputted to the driver IC 47 through a second clock signal line (not shown in figures). The second clock signal line is connected to the control device 9 as a single signal line, but split into six signal lines on its way to the six driver ICs 47, each of which is connected to one of the six head units 3*x*.

The FIRE may be inputted to the driver IC 47 through the ejection timing signal line 9*a* (see FIG. 2A), at every predetermined ejection period. The ejection period may be the time necessary for the paper sheet P to relatively move with respect to the head 3 by a unit distance corresponding to the resolution of the image to be recorded on the paper sheet P. The ejection timing signal line 9*a* is connected to the control device 9 as a single signal line, but split into six signal lines on its way to the six driver ICs 47, each of which is connected to one of the six head units 3*x*. The SIN may be received by the driver ICs 47 through the control signal lines 9*b* (see FIG. 2A). The control signal lines 9*b* serve to connect the control device 9 and the six driver ICs 47, such that each of the six signal lines is routed between the control device 9 and one of the six driver ICs 47. The second clock signal CLK 2 may be inputted to the driver IC 47 through the signal line 9*d* (see FIG. 6; not shown in FIG. 2A).

Figure 6:
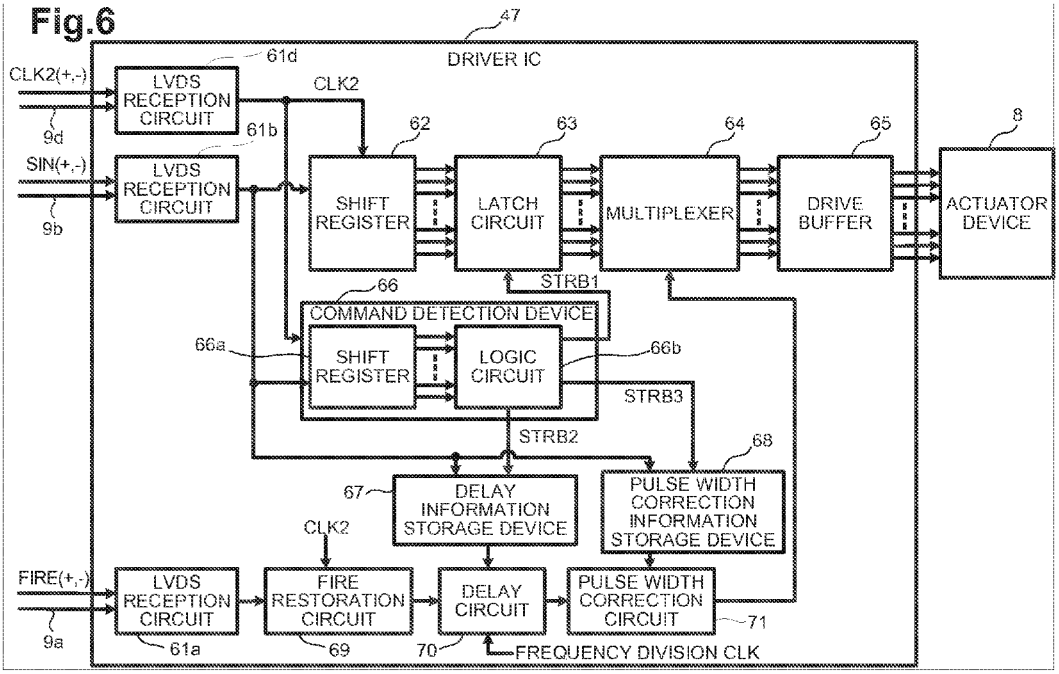
FIG. 6 is a block diagram showing an example configuration of a driver IC.

The FIRE, the SIN, and the CLK 2 are transmitted from the control device 9 to the driver ICs 47 in the form of pulse-type differential signals through a pair of signal lines respectively. In other words, although the signal lines 9*a*, 9*b*, and 9*d* are each drawn as a single line in FIG. 2A, the signal lines 9*a*, 9*b*, and 9*d* may actually each comprise a pair of signal lines. In FIGS. 2A and 6, the differential signal of the FIRE is expressed as FIRE (+, −), the differential signal of the SIN is expressed as SIN (+, −), and the differential signal of the CLK 2 is expressed as CLK 2 (+, −). In the differential mode, complementary signals (High signal and Low signal) are respectively transmitted to one and the other of the pair of signal lines. The differential mode may be more resistant to noise than a single end mode in which a signal is transmitted through a single signal line, and in which the amplitude of the signal can be reduced to as low as the order of 100 mV for transmission in a low voltage.

The head 3 includes an EEPROM 48 as shown in FIGS. 2A and 5A. The EEPROM 48 may contain relative position information indicating a deviation amount from the reference position of each of the six head units 3*x*, and characteristic information indicating the characteristic of the respective head units 3*x*. The information stored in the EEPROM 48 is inputted to the head control circuit 53*a* through the signal line 9*c* (see FIG. 2A) connecting the control device 9 and the EEPROM 48. Such types of information may be recorded in the EEPROM 48, for example, during the manufacturing process of the head 3.

The CPU 50 may generate the delay information indicating a delay amount to be applied to the FIRE and the SIN, on the basis of the relative position information stored in the EEPROM 48, and may write the delay information in the unit-based FIRE delay register 35 and the unit-based SIN delay register 34. The CPU 50 may also generate the pulse width correction information indicating the correction amount of the pulse width of the driving signal on the basis of the characteristic information stored in the EEPROM 48, and may write the pulse width correction information in the unit-based pulse width register 36. The generation methods of the delay information and the pulse width correction information will be subsequently described in detail. The delay information and the pulse width correction information may be transmitted to a desired driver IC 47, through the corresponding one of the six control signal lines 9*b*.

The six driver ICs 47 respectively corresponding to the head units 3*x* may have the same structure, and each may include, as shown in FIG. 6, low voltage differential signaling (LVDS) reception circuits 61*a*, 61*b*, and 61*d*, a shift register 62, a latch circuit 63, a multiplexer 64, a drive buffer 65, a command detection device 66, a delay information storage device 67, a pulse width correction information storage device 68, a FIRE restoration circuit 69, a delay circuit 70, and a pulse width correction circuit 71.

The LVDS reception circuits 61*a*, 61*b*, and 61*d* may receive the differential signal of the FIRE, the SIN, and the CLK 2, respectively. The shift register 62 may convert the serial data of each nozzle 24 according to the SIN inputted from the LVDS reception circuit 61*b* into parallel data, and may input the parallel data to the latch circuit 63 in synchronization with the second clock signal CLK 2. The latch circuit 63 may be implemented with a D-flip-flop circuit, and may input the parallel data received from the shift register 62 to the multiplexer 64 at a time, in synchronization with a strobe signal STRB1 to be subsequently described. The multiplexer 64 may select the waveform pattern of the driving signal from the eight waveform patterns (see FIGS. 4A-4H) so as to generate the waveform signal, on the basis of the data inputted from the latch circuit 63, and may input the waveform signal to the drive buffer 65. The drive buffer 65 may amplify the waveform signal inputted from the multiplexer 64 to thereby generate the driving signal, and may transmit the driving signal to each of the individual electrodes 42 of the actuator device 8. In this process, the drive buffer 65 may transmit, at a delayed timing, the driving signal representing the pulse width corrected on the basis of the delayed/corrected data (to be subsequently described) received from the pulse width correction circuit 71 through the multiplexer 64, to the desired individual electrode 42.

The command detection device 66 may include a shift register 66*a* that converts the serial data of each nozzle 24 according to the SIN received from the LVDS reception circuit 61*b* into parallel data, and a logic circuit 66*b* to which the parallel data is transmitted from the shift register 66*a*. Three special pattern signals, different from the SIN signal, are further received by the logic circuit 66*b*. The three special pattern signals include a signal for determining the timing of a latch in the latch circuit 63, a signal for use in determining delay information, and a signal for determining a setting of the pulse width correction. Upon receipt of the three special pattern signals, the logic circuit 66*b* outputs a strobe signal STRB1 to be transmitted to the latch circuit 63, a second strobe signal STRB2 to be transmitted to the delay information storage device 67, and a third strobe signal STRB3 to be transmitted to the pulse width correction information storage device 68. Here, the SIN generation circuit 38 inserts the special pattern signals in the SIN, so that the logic circuit 66*b* outputs the STRB1 at every ejection period.

The delay information storage device 67 and the pulse width correction information storage device 68 may both be volatile registers, and each may include a shift register that converts the serial data according to the delay information and the pulse width correction information received from the LVDS reception circuit 61*b* into parallel data, and a latch circuit that latches the parallel data. The latch circuits included in the delay information storage device 67 and the pulse width correction information storage device 68 may input the parallel data to the delay circuit 70 and the pulse width correction circuit 71, respectively, in synchronization with the STRB2 signal and the STRB3 signal inputted from the command detection device 66. Thus, the delay information and the pulse width correction information, transmitted to the driver IC 47 through the control signal line 9*b* in the delay information generation process and the pulse width correction information generation process to be subsequently described, may contain the special patterns so that the STRB2 and the STRB3 are generated for the respective information.

The FIRE restoration circuit 69 may convert the serial data according to the FIRE signal (ejection timing signal) inputted from the LVDS reception circuit 61*a* into five pieces of parallel data (e.g., the same number as that of the waveform patterns of the driving signal), in synchronization with the second clock signal CLK 2, and may transmit the parallel data to the delay circuit 70. The delay information may be transmitted to the delay circuit 70 from the delay information storage device 67 before the parallel data is received from the FIRE restoration circuit 69. Upon receipt of the parallel data after the delay information is received, the delay circuit 70 generates delayed data which may be delayed from the parallel data according to the FIRE signal by the delay amount indicated by the delay information. Then the delay circuit 70 may input the generated delayed data to the pulse width correction circuit 71. Here, a frequency-divided CLK, obtained by dividing the second clock signal CLK 2 inputted to the driver IC 47 by a predetermined value (e.g., 5), may be inputted to the delay circuit 70. The delay circuit 70 may delay the parallel data in synchronization with the frequency-divided CLK.

The pulse width correction circuit 71 may generate the delayed/corrected data by correcting the pulse width of the driving signal on the basis of the delayed data inputted from the delay circuit 70 and the pulse width correction information inputted from the pulse width correction information storage device 68, and may input the delayed/corrected data to the multiplexer 64.

Figure 7:
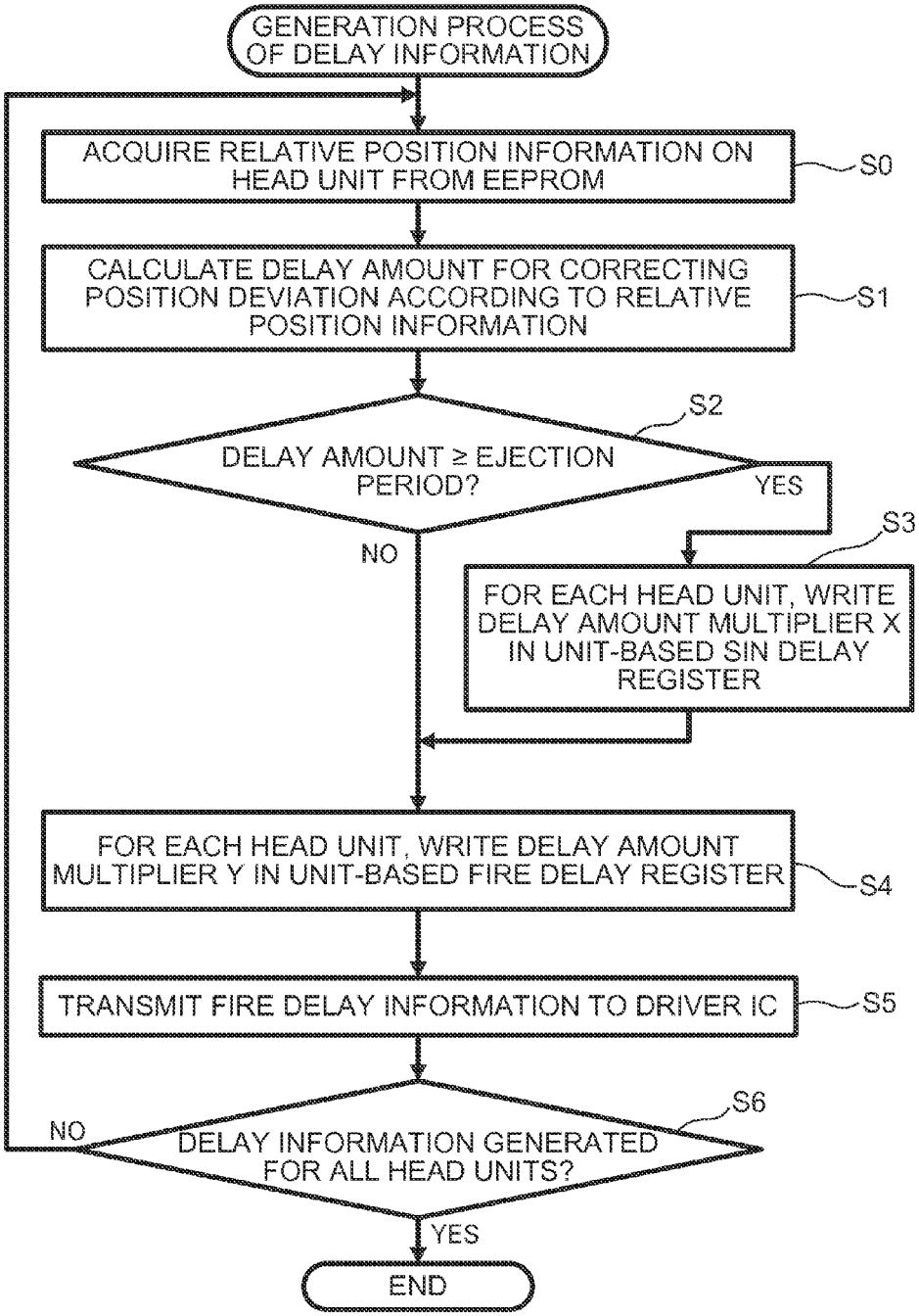
FIG. 7 is a flowchart showing an example generation process of delay information.

Referring now to FIG. 7, the delay information generation process will be described. This process may be executed by the CPU 50 and the head control circuit 53*a* controlled by the CPU 50. As described above, at least one of the head units 3*x* may deviate from the reference position in the sub scanning direction to the downstream side in the convey direction. Therefore, if the ink were ejected at the same timing as in the case where all the head units 3*x* are located in the reference position, the landing position of the ink on the paper sheet P would deviate to the downstream side in the convey direction. In this embodiment, accordingly, the deviation of the ink landing position on the paper sheet P may be corrected by delaying the ink ejection timing. In the delay information generation process, the delay information indicating the delay amount may be generated for each of the head units 3*x*. Here, the delay information generation process may be performed each time the power supply to the head control circuit 53*a* and the driver IC 47 is turned on from an off state. This may be the case when the unit-based SIN delay register 34 and the delay information storage device 67 of the head control circuit 53*a* are volatile registers. In some embodiments, the delay information generation process may be performed periodically or in response to various events (e.g., returning from a standby mode).

First, the CPU 50 acquires the relative position information of each head unit 3*x*, from the EEPROM 48 (step S0). The relative position information is individual data of each of the head units 3*x* and includes, for example, the data indicating the deviation amount from the reference position in the sub scanning direction.

After step S0, the CPU 50 may calculate, with respect to each of the six head units 3*x*, the delay amount which is the time necessary for correcting the deviation of the ink landing position, on the basis of the deviation amount from the reference position in the sub scanning direction. More specifically, the CPU 50 may divide the deviation amount from the reference position in the sub scanning direction by the unit distance corresponding to the resolution of the image to be recorded on the paper sheet P. In other words, the delay amount may represent the number of ejection periods that have to be delayed in order to enable the ink ejected from a given head unit 3*x* to 1 and on the same position on the paper sheet P as in the case where that head unit 3*x* is located at the reference position in the sub scanning direction.

After step S1, the head control circuit 53*a* may determine whether the delay amount corresponding to each of the head units 3*x* obtained on the basis of the deviation amount in the sub scanning direction acquired at S1 is equal to or larger than one ejection period (step S2). In the case where the delay amount is equal to or larger than one ejection period (YES at S2), the head control circuit 53*a* may write the value of the delay amount (e.g., a time) by writing a multiplier X (X=natural number not smaller than 1) representing a number of times the ejection period in the unit-based SIN delay register 34 should be multiplied, in association with the relevant head unit 3*x* (S3). After S3, and in the case where the delay amount is smaller than the ejection period (NO at S2), the head control circuit 53*a* may write the value of the delay amount, by writing another multiplier Y (Y=a natural number including zero) corresponding to one or more digits in the decimal portion of the number obtained by dividing the delay amount by the ejection period in the unit-based FIRE delay register 35, in association with the relevant head unit 3*x* (S4).

After S4, at which the correction information indicating the delay amounts for the respective head units 3*x* is written in the unit-based FIRE delay register 35, the driver IC I/F 30 may transmit the delay information to the driver IC 47 of the respectively corresponding head unit 3*x* (S5). As described above, the delay information transmitted to the driver IC 47 includes the special pattern signals for generating the STRB2 for every predetermined unit of the information.

After S5, the head control circuit 53*a* may decide whether the delay information has been generated and written in the register with respect to all of the six head units 3*x* (S6). In the case where the delay information has not been generated and written for all of the head units 3*x* (NO at S6), the head control circuit 53*a* may return to S1, acquire the relative position information of the head unit 3*x* about which the delay information has not yet been generated, and perform the subsequent steps. In the case where the delay information has been generated for all the head units 3*x* (YES at S6), the head control circuit 53*a* may finish the current routine.

Figure 8:
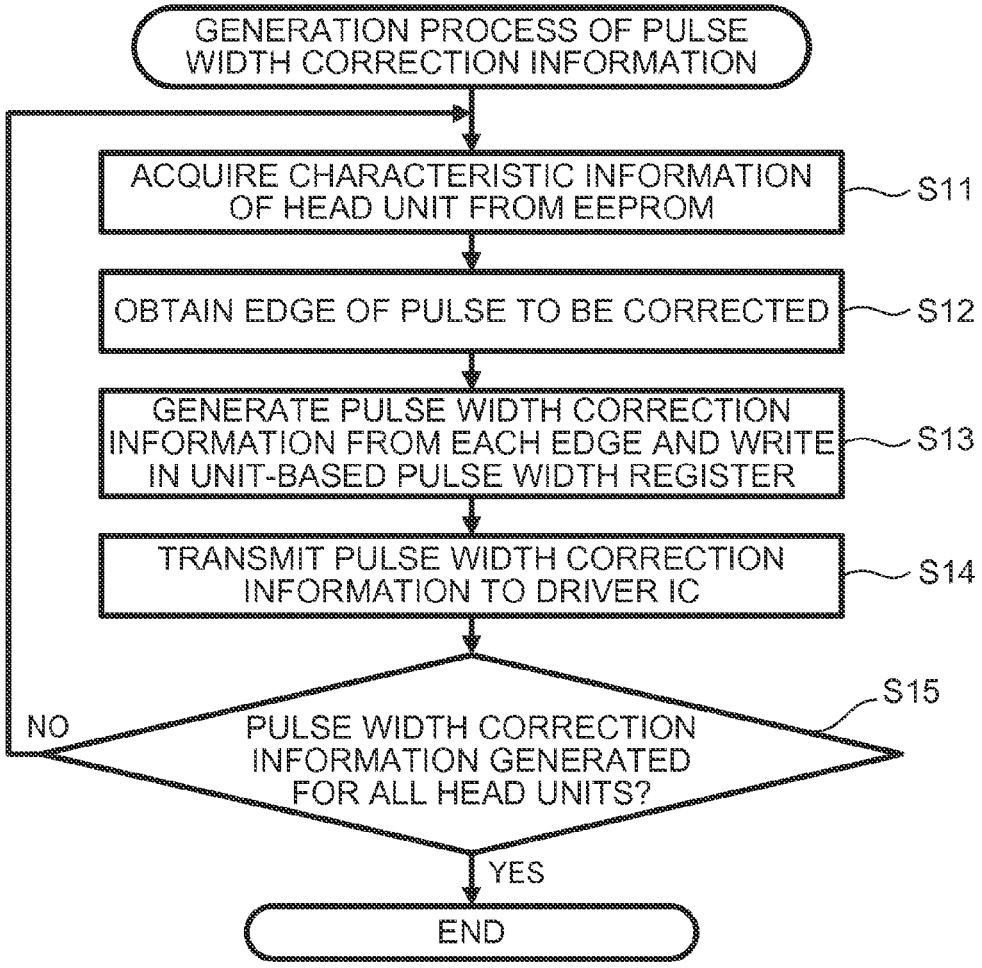
FIG. 8 is a flowchart showing an example generation process of pulse width correction information.

Referring next to FIG. 8, the pulse width correction information generation process will be described. This process may be executed by the CPU 50 and the head control circuit 53*a* controlled by the CPU 50. Here, the pulse width correction information generation process may be performed each time the power supply to the head control circuit 53*a* and the driver IC 47 is turned on from an off state. This may be the case where the pulse width correction information storage device 68 is a volatile register. In some embodiments, the pulse width correction information generation process may be performed periodically or in response to various events (e.g., returning from a standby mode).

First, the head control circuit 53*a* may acquire the characteristic information of each head unit 3*x* from the EEPROM 48 (S11). The characteristic information may be individual data of the respective head units 3*x* and may include, for example, data indicating an acoustic length (AL) or a propagation time of a pressure wave.

After S11, the head control circuit 53*a* may obtain an edge of a pulse, having a width which is to be corrected, on the basis of the characteristic information acquired at S11 (S12). Then the head control circuit 53*a* may generate, with respect to each edge obtained at S12, pulse width correction information such that the rising and falling timings may be changed so as to increase or decrease the width of the relevant pulse. The head control circuit 53*a* may also write the pulse width correction information in the unit-based pulse width register 36 (S13).

After S13, at which the pulse width correction information indicating the delay amounts for the respective head units 3*x* is written in the unit-based pulse width register 36, the driver IC I/F 30 may transmit the pulse width correction information to the driver IC 47 of the respectively corresponding head unit 3*x* (S14). As described above, the pulse width correction information transmitted to the driver IC 47 includes the special pattern signals for generating the STRB3 for every predetermined unit of the information.

After S14, the head control circuit 53*a* may decide whether the pulse width correction information has been generated with respect to all of the six head units 3*x* (S15). In the case where the pulse width correction information has not been generated for all of the head units 3*x* (NO at S15), the head control circuit 53*a* may return to S11, acquire the characteristic information of the head unit 3*x* about which the pulse width correction information has not yet been generated, and perform the subsequent steps. In the case where the pulse width correction information has been generated for all of the head units 3*x* (YES at S15), the head control circuit 53*a* may finish the current routine.

The head control circuit 53*a* may input the delay information and the pulse width correction information generated as above to the desired driver IC 47, each time the power supply to the driver IC 47 is turned on from an off state. This may be the case when the delay information and the pulse width correction information, stored in the delay information storage device 67 and the pulse width correction information storage device 68, respectively, are erased each time the power supply to the driver IC 47 is disconnected.

As described throughout the foregoing passages, in some embodiments, the ejection timing signal line 9*a* is provided, and the delay circuit 70 is provided in each of the six driver ICs 47, instead of the configuration in which the driving pulses each representing a different delay amount are inputted from the control device 9 to the corresponding one of the six driver ICs 47. Therefore, the liquid ejecting apparatus may be configured to prevent or reduce degradation of recording performance originating from position deviation of the six head units 3*x* with relatively few wirings.

Regarding the delay amount indicated by the delay information, the control device 9 may transmit the multiplier X or multiplier Y as the delay amount to the desired driver IC 47. Specifically, where the delay amount is smaller than the ejection period, the multiplier Y may be transmitted to the desired driver IC 47. Meanwhile, where the delay amount is larger than the ejection period, the multiplier X may be transmitted to the desired driver IC 47. Such an arrangement enables a delay amount to be determined based on the ejection period.

The control device 9 may generate the pulse width correction information on the basis of the characteristic information, and input the pulse width correction information to the desired driver IC 47. The six driver ICs 47 may each include a pulse width correction circuit 71, which inputs the driving signal representing the corrected pulse width to the desired individual electrode 42. Such an arrangement suppresses degradation in recording quality originating from fluctuation of characteristics among the six head units 3*x*.

The head 3 includes the EEPROM 48 containing the relative position information, and the control device 9 and the EEPROM 48 are connected through the signal line 9*c*. With such a configuration, even when the head 3 is replaced the ejection timing signal can be delayed according to the new head 3.

Modifications

In addition to the example embodiments described in detail above, it is to be understood that various modifications may be made within the scope set forth in the appended claims. Some example modifications are described below.

In the delay information generation process, in some embodiments, it might not necessary to generate the delay information with respect to a head unit 3X located at the reference position.

The number of nozzle rows in the head unit 3X may be fewer than six (including one) or seven or more.

The liquid ejecting apparatus may be a serial type apparatus, and thus, is not limited to the line type apparatus. In the case of the serial type apparatus, the nozzle row is composed of a plurality of nozzles aligned in the head unit 3X in the sub scanning direction. In addition, a plurality of head units are aligned in the sub scanning direction. In this case, the sub scanning direction corresponds to the predetermined direction according to the present invention.

The liquid ejecting apparatus is not limited to a printer, but may be a facsimile machine, a copier, etc.

The number of liquid ejecting heads mounted in the liquid ejecting apparatus may be any number not smaller than 1.

The number of head units 3X provided in the liquid ejecting head is not limited to 6, but may be any number not smaller than 2.

It is not mandatory to arrange the plurality of head units 3X in a checkerboard pattern. Any desired number of head units 3X may be arranged in the main scanning direction.

It is not mandatory that the plurality of head units 3X be physically spaced from each other as a whole. For example, in a configuration in which the liquid ejecting head 3 includes a flow path unit and a plurality of actuator devices 8 fixed on the flow path unit, the portion of the flow path unit corresponding to each of the plurality of actuator devices 8 may constitute the head unit 3X.

The liquid ejected through the nozzle 24 is not limited to ink, but may be any desired liquid. In addition, each of the plurality of head units 3*x* may eject a different type of liquid through the nozzles thereof, and a plurality of types of liquid may be ejected through the nozzles 24 of a given head unit 3X.

It is not mandatory to employ a piezoelectric element for the actuator, but a different method may be adopted. For example, a thermal method utilizing a heat generating element as the actuator, or an electrostatic method utilizing electrostatic force.

The control signal is not limited to the waveform pattern selection signal but may be, for example, a stop signal (that stops the operation of the driver IC) inputted to the driver IC in the case where the temperature of the head unit exceeds a predetermined threshold.

The waveform patterns of the driving signal are not limited to those described above, but may be modified as desired. In addition, it is not mandatory that the driving signal represent three or more waveform patterns. Rather, the driving signal might only represent two waveform patterns, namely ejecting and non-ejecting (in other words, without the gradation control).

It is not mandatory that the delay information be generated by the control device 9. For example, the delay information may be stored in a desired storage device in advance (for example, EEPROM 48), and the control device 9 may acquire the delay information from that storage device and input the acquired delay information to the driver IC.

It is not mandatory that the relative position information storage device be included in the liquid ejecting head. The relative position information storage device may be separate from the liquid ejecting head.

The characteristic information storage device may be omitted. It is not mandatory that the control device 9 generate the pulse width correction information. Each of the plurality of driver ICs does not have to possess the pulse width correction function.

The delay information storage device 67 may be omitted.

The ejection timing signal may be delayed not for all the waveform patterns but a subset of the waveform patterns. In addition, the correction of the pulse width of the driving signal may be performed not for all the edges in the driving signal but a subset of the edges.

The plurality of waveform patterns for the driving signal may be generated by the driver IC, instead of the control device 9. In this case, the waveform pattern generation circuit may be included in the driver IC. The waveform pattern generation circuit may generate the plurality of waveform patterns upon receipt of the ejection timing signal. The plurality of waveform patterns generated by the waveform pattern generation circuit may be delayed by a delaying unit.

When the driver IC does not possess the pulse width correction function, the pulse width correction information may be inputted to the waveform pattern generation circuit. In this case, the waveform pattern generation circuit generates the plurality of waveform patterns on the basis of the inputted pulse width correction information.

Further, the waveform pattern generation circuit may be included in the liquid ejecting head 3, instead of the driver IC of the respective head units 3*x*.

The delay information generation process and the pulse width correction information generation process may be performed each time before a recording job is performed on a recording medium.

The correction of the position deviation of the head units 3X may be performed not only for the deviation to the downstream side in the convey direction, but also for the deviation to the upstream side in the convey direction. For example, when a head unit is deviated to the upstream side in the convey direction and the ejection timing has to be expedited by 3.6 periods, the delay information generation process may be arranged as follows. At S3, information for expediting by 4 periods may be written in the unit-based SIN delay register 34, and a delay amount of 0.4 period may be written in the unit-based FIRE delay register 35 at S4. Further, in the case where the ink jet printer 1 is configured to employ the FIRE signal from the second and subsequent periods when the head unit 3X is located at the reference position, the following arrangement may be made. Information for expediting by 3 periods may be written in the unit-based SIN delay register 34 at S3, and a delay amount of 0.6 period may be written in the unit-based FIRE delay register 35 at S4. Thus, delaying the FIRE signal of the immediately preceding period creates a situation as if the FIRE signal had been expedited.

The ASIC 53 may be omitted, in which case the CPU 50 may execute a program in which the function of the ASIC 53 is stored in memory (e.g., the ROM 51).

What is claimed is:

1. A liquid ejecting apparatus comprising:

a liquid ejecting head including a plurality of head units each having a nozzle row including a plurality of nozzles for ejecting liquid of the same color, wherein the plurality of head units include:

a plurality of pressure chambers each communicating with a corresponding one of the plurality of nozzles;

a plurality of actuators each disposed so as to correspond to one of the pressure chambers and each configured to apply force to the liquid stored in the corresponding pressure chamber for ejecting the liquid through the nozzle communicating with the corresponding pressure chamber on the basis of a corresponding driving signal; and a plurality of drive control devices each disposed so as to correspond to one of the head units and each configured to output the corresponding driving signal to the corresponding actuator in the corresponding head unit;

a control device;

an ejection timing signal line connected to the control device as a single signal line and split into a plurality of signal lines each connected to a corresponding one of the drive control devices; and a plurality of control signal lines each connecting the control device and a corresponding one of the drive control devices, wherein the control device is configured to:

generate an ejection timing signal indicating an ejection timing of the liquid and control signals that control operation of the head units;

generate delay information indicating a time for delaying the ejection timing signal;

output the generated ejection timing signal to the ejection timing signal line;

output each of the generated control signals to a corresponding one of the control signal lines; and output the generated delay information to at least one of the control signal lines corresponding to a particular drive control device of the plurality of drive control devices, and wherein the plurality of drive control devices are each configured to:

generate the corresponding driving signal based on the corresponding control signal received via the corresponding control signal line;

delay the ejection timing signal by the time indicated by the delay information received via the corresponding control signal line; and output the corresponding driving signal to the corresponding actuator in accordance with a timing indicated by the delayed ejection timing signal.

2. The liquid ejecting apparatus according to claim 1, further comprising a relative position information storage device configured to store, with respect to each of the plurality of head units, relative position information indicating a position with respect to a reference position in a sub scanning direction, wherein the control device is configured to generate the delay information on the basis of the relative position information.

3. The liquid ejecting apparatus according to claim 2, wherein the ejection timing signal is outputted from the control device at every predetermined ejection period, and the control device is configured to:

calculate a multiplier for each of the control signals on the basis of the relative position information, wherein each of the multipliers indicates a number of ejection periods by which the corresponding control signal is to be delayed; and output each of the generated control signals to a corresponding one of the control signal lines on the basis of the corresponding multiplier.

4. The liquid ejecting apparatus according to claim 3, wherein the control device is configured to generate the delay information indicating a time shorter than the ejection period on the basis of the relative position information.

5. The liquid ejecting apparatus according to claim 2, wherein the liquid ejecting head further includes a relative position information signal line through which the relative position information is transmitted to the control device, the relative position information signal line connecting the control device and the relative position information storage device.

6. The liquid ejecting apparatus according to claim 1, wherein the plurality of actuators are configured to:

receive the driving signal representing one of a plurality of waveform patterns; and apply force to the liquid stored in the corresponding pressure chamber for ejecting the liquid by an amount corresponding to the waveform pattern of the received driving signal through the nozzle communicating with the corresponding pressure chamber, wherein the control signal includes a waveform pattern selection signal for selecting the waveform pattern of the driving signal from the plurality of waveform patterns, and wherein the plurality of drive control devices each output the driving signal, representing the waveform pattern selected according to the received waveform pattern selection signal, to a particular actuator according to the timing indicated by the ejection timing signal delayed by the drive control device.

7. The liquid ejecting apparatus according to claim 1, wherein the ejection timing signal is outputted from the control device at every predetermined ejection period, and the control device is configured to generate the delay information indicating a time shorter than the ejection period.

8. The liquid ejecting apparatus according to claim 1, further comprising a characteristic information storage device containing characteristic information indicating a characteristic of each of the plurality of head units, wherein the control device is configured to:

generate, on the basis of the characteristic information, pulse width correction information indicating a correction amount of the pulse width of the driving signal, and output the generated pulse width correction information to the control signal line corresponding to the particular drive control device among the plurality of control signal lines, and wherein the plurality of drive control devices are each configured to:

correct the pulse width of the driving signal on the basis of the pulse width correction information received from the control device, and output the corrected driving signal to the corresponding actuator.

9. The liquid ejecting apparatus according to claim 1, wherein the particular drive control device further includes a delay information storage device that stores therein the delay information received by the particular drive control device, and the particular drive control device is configured to delay the ejection timing signal by a time corresponding to the delay information stored in the delay information storage device, and the control device is configured to output the delay information to the particular drive control device, each time the plurality of drive control devices is turned on from an off state.

10. The liquid ejecting apparatus according to claim 1, wherein the plurality of head units are arranged in a checkerboard pattern.

11. The liquid ejecting apparatus according to claim 1, wherein at least one of the plurality of head units is separated by another of the plurality of head units in a sub scanning direction.

12. One or more non-transitory, computer-readable media storing computer-readable instructions therein that, when executed by one or more processors of a liquid ejecting apparatus comprising a liquid ejecting head including a plurality of head units each having a plurality of actuators each configured to apply force to liquid stored in a corresponding pressure chamber for ejecting the liquid on the basis of a corresponding driving signal, cause the liquid ejecting apparatus to:

generate an ejection timing signal indicating an ejection timing of the liquid, control signals that control operation of the head units, and delay information indicating a time for delaying the ejection timing signal;

output the generated ejection timing signal to an ejection timing signal line connected to a control device as a single signal line and split into a plurality of signal lines each connected to a corresponding one of the head units;

output one control signal among the generated control signals and the generated delay information to one of a plurality of control signal lines corresponding to a particular one of the head units, wherein each of the plurality of control signal lines connects the control device and a corresponding one of the head units;

generate one of the driving signals based on the outputted control signal;

delay the ejection timing signal by the time indicated by the delay information; and output the generated driving signal to be received by a particular one of the actuators in accordance with a timing indicated by the delayed ejection timing signal.

13. An apparatus, comprising:

a plurality of head units each having a nozzle row including a plurality of nozzles for ejecting liquid of the same color, wherein the plurality of head units comprise:

a plurality of pressure chambers each communicating with a corresponding one of the plurality of nozzles;

a plurality of actuators each disposed so as to correspond to one of the pressure chambers and each configured to apply force to the liquid stored in the corresponding pressure chamber for ejecting the liquid through the nozzle communicating with the corresponding pressure chamber on the basis of a corresponding driving signal; and a plurality of drive control devices each disposed so as to correspond to one of the head units and each configured to output the corresponding driving signal to the corresponding actuator in the corresponding head unit;

wherein each of the plurality of drive control devices are configured to:

generate the corresponding driving signal based on a corresponding control signal received via a corresponding control signal line from among a plurality of control signal lines respectively connected to the plurality of drive control devices;

delay an ejection timing signal received via an ejection timing signal line by a time indicated by delay information received via the corresponding control signal line, wherein the ejection timing signal line connects to a control device as a single line and splits into a plurality of lines connected to the plurality of drive control devices, respectively; and output the corresponding driving signal to a particular one of the actuators in accordance with a timing indicated by the delayed ejection timing signal.

14. The apparatus according to claim 13, further comprising a relative position information storage device configured to store, with respect to each of the plurality of head units, relative position information indicating a position with respect to a reference position in a sub scanning direction, wherein the delay information is generated on the basis of the relative position information.

15. The apparatus according to claim 13, wherein the plurality of actuators are configured to:

receive the driving signal representing one of a plurality of waveform patterns; and apply force to the liquid stored in the corresponding pressure chamber for ejecting the liquid by an amount corresponding to the waveform pattern of the received driving signal through the nozzle communicating with the corresponding pressure chamber, wherein the control signal includes a waveform pattern selection signal for selecting the waveform pattern of the driving signal from the plurality of waveform patterns, and wherein the plurality of drive control devices each output the driving signal representing the waveform pattern selected according to the received waveform pattern selection signal, to a particular actuator according to the timing indicated by the ejection timing signal delayed by the drive control device.

16. The apparatus according to claim 13, wherein the ejection timing signal is outputted from the control device at every predetermined ejection period, and the delay information indicates a time shorter than the ejection period.

17. The apparatus according to claim 13, wherein the plurality of head units are arranged in a checkerboard pattern.

18. The apparatus according to claim 13, wherein at least one of the plurality of head units is separated by another of the plurality of head units in a sub scanning direction.

* * * * *